US010450658B2

(12) United States Patent
Li et al.

(10) Patent No.: US 10,450,658 B2
(45) Date of Patent: Oct. 22, 2019

(54) ALLOY SURFACE ACTIVATION BY IMMERSION IN AQUEOUS ACID SOLUTION

(71) Applicant: CASE WESTERN RESERVE UNIVERSITY, Cleveland, OH (US)

(72) Inventors: Zhen Li, Shaker Heights, OH (US); Frank Ernst, Cleveland, OH (US); Harold Kahn, Charlottesville, VA (US); Arthur Heuer, Cleveland, OH (US)

(73) Assignee: CASE WESTERN RESERVE UNIVERSITY, Cleveland, OH (US)

( * ) Notice: Subject to any disclaimer, the term of this patent is extended or adjusted under 35 U.S.C. 154(b) by 0 days.

(21) Appl. No.: 15/308,223

(22) PCT Filed: May 6, 2015

(86) PCT No.: PCT/US2015/029372

§ 371 (c)(1),
(2) Date: Nov. 1, 2016

(87) PCT Pub. No.: WO2015/171698

PCT Pub. Date: Nov. 12, 2015

(65) Prior Publication Data

US 2017/0081767 A1 Mar. 23, 2017

Related U.S. Application Data

(60) Provisional application No. 61/989,228, filed on May 6, 2014.

(51) Int. Cl.

| | |
|---|---|
| ***C23C 22/78*** | (2006.01) |
| ***C23C 22/06*** | (2006.01) |
| ***C23G 1/02*** | (2006.01) |
| ***C23C 22/02*** | (2006.01) |
| ***C23C 22/50*** | (2006.01) |
| ***C23G 1/08*** | (2006.01) |
| ***C23C 8/02*** | (2006.01) |
| *C25D 5/48* | (2006.01) |

(52) U.S. Cl.

CPC ..... *C23C 22/06* (2013.01); *C23C 8/02* (2013.01); *C23C 22/02* (2013.01); *C23C 22/50* (2013.01); *C23C 22/78* (2013.01); *C23G 1/02* (2013.01); *C23G 1/08* (2013.01); *C25D 5/48* (2013.01)

(58) Field of Classification Search

CPC ..... C23C 22/06; C23C 22/78
See application file for complete search history.

(56) References Cited

U.S. PATENT DOCUMENTS

| | | | | |
|---|---|---|---|---|
| 1,729,607 | A * | 10/1929 | Bezzenberger | C25D 3/20 205/131 |
| 1,755,559 | A * | 4/1930 | Pletsch | C23C 2/06 427/310 |
| 1,997,538 | A * | 4/1935 | Armstrong | B23K 20/227 164/75 |
| 3,699,013 | A * | 10/1972 | Miyata et al. | C23G 1/02 205/210 |
| 4,885,215 | A | 12/1989 | Yoshicka et al. | |
| 4,938,850 | A | 7/1990 | Rothschild et al. | |
| 4,975,147 | A | 12/1990 | Tahara et al. | |
| 5,372,655 | A | 12/1994 | Preisser et al. | |
| 5,792,282 | A | 8/1998 | Tahara et al. | |
| 6,093,303 | A | 7/2000 | Williams et al. | |
| 6,165,597 | A | 12/2000 | Williams et al. | |
| 2006/0228482 | A1* | 10/2006 | Memmi | C23C 2/02 427/299 |

FOREIGN PATENT DOCUMENTS

| | | | | |
|---|---|---|---|---|
| EP | 0787817 | A2 | | 8/1997 |
| GB | 795980 | A | | 6/1958 |
| JP | 04193937 | A | * | 7/1992 |
| JP | 09-268364 | A | | 10/1997 |
| JP | 2003300004 | A | * | 10/2003 |
| WO | 9003457 | A1 | | 4/1990 |
| WO | 2004007789 | A2 | | 1/2004 |
| WO | WO2007098308 | A1 | | 8/2007 |

OTHER PUBLICATIONS

Stickels, C.A., Gas Carburizing, ASM Handbook, 1991, pp. 312-314, vol. 4, ASM International Handbook Committee.

Michal G M et al: "Surface hardening of austenitic steels by low temperature colossal supersaturation" Materials Science & Technology, AIST/TMS Proceedings, Sep. 26-29, 2004, New Orleans, LA, vol. 2, Sep. 26, 2004-Sep. 29, 2004, pp. 347-353, AIST.

Jun Qu et al: "Low-temperature colossal carbon supersaturation enable anti-wear boundary film formation for austenitic stainless steels in oil-lubricated environment", Wear, vol. 271, No. 9, Jul. 23, 2011, pp. 1733-1738, Elsevier B.V.

(Continued)

*Primary Examiner* — Nathan H Empie

(74) *Attorney, Agent, or Firm* — Hudak, Shunk & Farine Co. LPA

(57) ABSTRACT

A process for surface activation or depassivation of an article, in particular an alloy, by immersion of the alloy in an aqueous acid solution. The surface activation methods of the present invention can be performed during a relatively short period of time and achieve reductions in production costs and provide environmental friendliness as compared to prior art processes. In a further embodiment, after surface activation, the article is immersed in a second liquid that prevents re-formation of a passivating oxide layer on the surface of the article. In a further embodiment the surface-activated alloys are subjected to surface engineering by a process that infuses carbon or nitrogen through the surface at a temperature sufficiently low to suppress precipitation of carbides or nitrides.

7 Claims, 2 Drawing Sheets

(56) References Cited

OTHER PUBLICATIONS

Shustak G et al: "Preparation and Characterization of n-Alkanoic Acid Self-Assembled Monolayers Adsorbed on 316L Stainless Steel", Langmuir, vol. 20, No. 18, Jul. 29, 2004, pp. 7499-7506, ACS Publications.

* cited by examiner

ALLOY SURFACE ACTIVATION BY IMMERSION IN AQUEOUS ACID SOLUTION

This invention was made with government support under the grant(s) DE-AC07-05ID14517 awarded by the Department of Energy. The government has certain rights in the invention.

FIELD OF THE INVENTION

The present invention relates to a process for surface activation or depassivation of an article, in particular an alloy, by immersion of the alloy in an aqueous acid solution. The surface activation methods of the present invention can be performed during a relatively short period of time and achieve reductions in production costs and provide environmental friendliness as compared to prior art processes. In a further embodiment, after surface activation, the article is immersed in a second liquid that prevents re-formation of a passivating oxide layer on the surface of the article. In a further embodiment the surface-activated alloys are subjected to surface engineering by a process that infuses carbon or nitrogen through the surface at a temperature sufficiently low to suppress precipitation of carbides or nitrides.

BACKGROUND OF THE INVENTION

For more than a decade, CWRU has been performing scientific research on a new concept of alloy surface engineering: case hardening (generating a "hard shell") by CSS (colossal supersaturation) with interstitial solutes. Interstitial solute refers to small atoms like carbon or nitrogen, which reside in small spaces between the regular positions of the ("substitutional") metal atoms in the crystal lattice of the alloy. CSS refers to a state in which the solute concentration is much (orders of magnitude) higher than the equilibrium solubility limit. For CSS surface hardening, alloy parts are exposed to a gas phase that provides interstitial solute (carbon or nitrogen) atoms to diffuse into the alloy surface. It has been shown for a broad variety of structural alloys (stainless steels, nickel-base alloys, cobalt-base alloys, titanium-base alloys) that high concentrations of interstitial solute significantly enhance the mechanical properties (hardness, wear resistance, and fatigue life) and the corrosion resistance. In addition to well-established alloy performance benefits, CSS is applied as a highly conformal post process to components in their final shape—without changing their dimensions—and at low cost. Therefore, CSS can make a very important contribution for developing better, safer, and longer-lasting parts of structural alloys. The potential for technical applications is tremendous.

The principle of surface engineering by CSS is well understood. Sufficiently high concentrations of interstitial solute atoms can be dissolved if the following conditions are fulfilled: (i) The alloys contain an element with a high affinity for the interstitial solute. (ii) The processing temperature is chosen such that the interstitial solute atoms can diffuse sufficiently fast for obtaining technically useful case depths in technically feasible amounts of processing time, but low enough to immobilize the ("substitutional") metal atoms, such that the interstitial solute atoms cannot precipitate with them as e.g. carbides or nitrides, which would be detrimental to the properties.

Surface Activation

It was found experimentally that for many alloys the native alloy surface is not transparent for inward diffusion of interstitial solute (carbon or nitrogen) at the (low) temperatures required for CSS. The reasons for this may not be perfectly understood. The current hypothesis is that effective infusion with carbon or nitrogen requires the removal of a thin barrier layer on the alloy surface. Making the surface transparent to inward-diffusing interstitial solute atoms is known as "surface activation."

In a broad variety of alloys that were studied, condition (i) is fulfilled by a significant fraction of Cr (chromium), an element with high affinity for carbon and nitrogen. Alloys with a suitable level of Cr contain this element typically to make them corrosion resistant. The corrosion resistance follows from the ability of Cr to form a thin (≈1 nm), passivating ("sealing") oxide layer on the surface. The oxide in this layer is typically rich in Cr. The problem that arises from this situation is that at processing temperatures that fulfill condition (ii), the passivating oxide layer may stay intact and obstruct the inward diffusion of carbon or nitrogen.

Another potential obstacle for the infusion of carbon or nitrogen into the surface of alloy parts with machined surfaces could be that the machining introduces heavy plastic deformation and contamination of the region closest to the surface and therefore leaves behind a thin layer with poor crystallinity and poor transparency for carbon or nitrogen.

Intense research over the past decade has revealed that for successful CSS case hardening, it is of greatest importance to effectively activate the surface, i.e. to make it transparent to inward diffusing carbon or nitrogen atoms. This finding confirms what was found earlier in U.S. Pat. No. 6,165,597, which discloses a procedure to activate the surface (i.e. remove oxide and/or damaged layer) with the help of HCl gas. This method of surface activation constitutes a key element for the process, for which FIG. 1 shows a temperature-time diagram. Once the surface has been activated, it stays active while infusion of interstitial solute proceeds.

Problems of Existing Technology

The problems of the existing technology, i.e. surface activation with the help of HCl gas at elevated temperature—250 to 450° C.—are numerous:

The activation by hot HCl gas is carried out in the CSS processing furnace, posing limits on process design.

The hot HCl gas causes rapid corrosion of the furnace hardware, which constitutes a significant cost factor.

The HCl gas is problematic under the aspects of safety and environmental pollution and sustainability.

In the current industrial process, surface activation requires a total of four hours of processing time.

The above factors imply increased production costs.

SUMMARY OF THE INVENTION

Using our own experimental gas furnace to carburize alloy tubes for nuclear fuel cladding, we found that surface activation with HCl gas does not always properly activate the surface of the tubes. For this reason, we experimented with immersing the tubes into an aqueous acid solution, in particular aqueous HCl solution (hydrochloric acid). This was carried out outside of the CSS processing furnace, prior to loading the specimens into the furnace. Shortly after this treatment, we loaded the specimens into the furnace and exposed them to a conventional activation process, similar to the process disclosed in U.S. Pat. No. 6,165,597. We found that the immersion in aqueous HCl solution prior to loading the specimens into the furnace dramatically improved the success of CSS processing.

Encouraged by these results, we speculated that the activation step with HCl gas may not be needed at all if the specimens were immersed in an aqueous acid solution, such as aqueous HCl solution, prior to loading them into the furnace for further CSS processing (infusion of carbon or nitrogen). This is counterintuitive because if the main barrier to inward diffusion of carbon or nitrogen were the passivating, chromium-rich oxide layer on the alloy surface, which is known to be only a few nanometers thick, one may have expected that there is enough time for this layer to re-form before carburization can be started. However, our experimental results demonstrate that surface activation by immersion in aqueous acid, such as HCl solution, can be sufficient for effective activation and obviate the need for HCl gas. Possibly, immersion in aqueous acid (HCl) solution and the subsequent rinse in ethanol and drying can passivate the surface against immediate oxidation for an amount of time sufficient to load the specimens into the furnace and start CSS processing (carburization, nitridation, or a combination thereof—nitro-carburization). Another possibility is that it is actually not the passivating surface oxide that constitutes the main barrier against infusion of interstitial solute atoms, but the layer of poor crystallinity generated by surface machining, which may be effectively removed by the liquid acid, for example HCl.

This disclosure comprises several aspects. In one aspect, a surface-activated article-containing composition is disclosed. This comprises an article having at least one portion of its surface activated and a liquid covering this at least one portion for temporarily preventing the formation of a passivating layer (which would impede infusion of carbon or nitrogen) on the at least one activated portion, the liquid comprising one or more of an alcohol, an aqueous acid, a fatty acid, an oil, and water.

In another aspect, a process for activating a surface of an alloy article is disclosed. This includes the steps of obtaining an article comprising an alloy and activating at least one surface of the article with an aqueous acid solution.

In a further aspect, a process for preventing oxidation of a surface of an alloy article is disclosed. This comprises the steps of activating at least one surface portion of an alloy article and immersing the at least one surface portion of the article in (or contacting it with) a liquid comprising one or more of an alcohol, an aqueous acid, a fatty acid, an oil, and water prior to formation of a passivating layer on the at least one surface portion.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
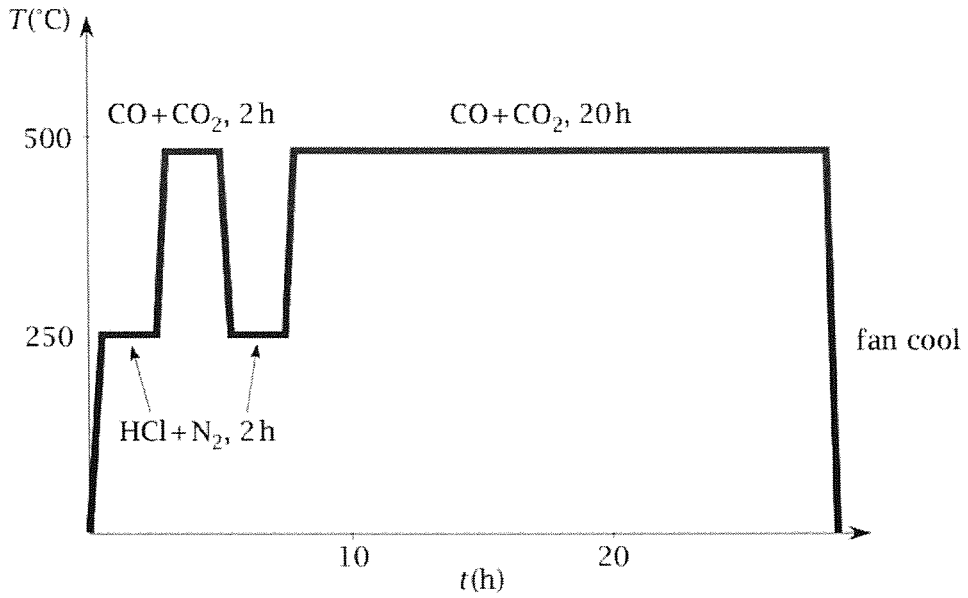
FIG. 1 is a temperature-time diagram of a prior-art process.

The present invention provides methods for surface activation of alloys by immersion in an aqueous acid solution. The concentration of the acid can be varied in order to produce desired surface activation. Various aqueous acids can be utilized in the practice of the present invention including, but not limited to, hydrochloric acid, hydrofluoric acid, hydrobromic acid and sulfuric acid. The concentration of the acid, the immersion time, and the temperature of the acid need to be adjusted for completely removing the passivating layer from the alloy surface while, at the same time, minimizing damage to the alloy part, e.g. by removal of alloy material below the passivating layer or pitting. The suitable range of acid concentrations corresponds to the pH range from +4 to −1. The suitable range of etching time is between 1 s and 10 ks. The suitable range of etching temperature is between 220 K (−50° C.) and 380 K (100° C.). The acid may contain wetting agents and/or components for buffering the pH value or controlling viscosity.

Likewise, many different articles or alloys can be subjected to the surface activation process of the present invention including, but not limited to, the following: (i) Stainless steels, such as austenitic stainless steels, martensitic stainless steels, precipitation-hardened stainless steels, duplex stainless steels. (ii) Nickel-base alloys. (iii) Cobalt-base alloys. (iv) Titanium-base alloys. Various other parameters, such as processing temperature, processing time, etc. can be varied. Room-temperature processing and the option of processing outside of the CSS processing furnace reduces the need for additional equipment or devices to maintain the chosen temperature of the aqueous solution in a processing vessel.

Once the desired surface activation of the alloy has been achieved, the part or article can be then subjected to CSS processing (carburization, nitridation, or a combination thereof—nitro-carburization) in order to case-harden at least one portion of the part.

In a further embodiment, after the activation or depassivation step, the article is or at least portions of the article are contacted with, preferably immersed, in a liquid that prevents or significantly retards the formation of an oxide layer, such as chromium-rich oxide, on at least one surface of the article. The article or alloy can remain immersed or otherwise coated with the liquid on desired surfaces thereof until the article can be subjected to CSS processing. Suitable liquids include, but are not limited to, alcohol (such as but not limited to ethanol), water, oil, or fatty acids (such as but not limited to a mixture of iso-octadecanoic acid, iso-tridecanoic acid, and 2-butyl ocatnoic acid).

In one important aspect of the present invention, the post-depassivating solution is a liquid that has a suitable boiling point that allows the solution or residuals thereof to evaporate upon heating in the carburization process. Suitable boiling points range from about 50 to about 500° C., and preferably from about 400 to about 450° C. Immersion of the article can be maintained for convenience and/or handling purposes until the article is ready to be subjected to the carburization process or any other desired processing step. In another aspect, the post-depassivating solution is a liquid that tends to wet the alloy surface. For improving this behavior, it may contain suitable wetting agents.

It is also noted that surface activation or depassivation can be performed utilizing other techniques for activating stainless steel and other metal articles prior to the process for preventing formation of the oxide layer by immersion in or coating with the post-passivation liquid. Examples include contacting the workpiece with a hydrogen halide gas such as HCl or HF at elevated temperature (e.g. 260 to 450° C.), contact with a strong base, electroplating with iron, contact with liquid sodium and contact with a molten salt bath including sodium cyanide. These techniques are described, for example, in U.S. Pat. Nos. 6,093,303; 5,792,282; EPO 0787817 and Japanese Patent Document 9-14019 (Kokai 9-268364). See also Stickles et al., "Heat Treating", pp 312, 314, Volume 4, ASM Handbook, copyright 1991, ASM International as well as U.S. Pat. Nos. 4,975,147, and 5,372,655, the disclosures of which are also incorporated herein by reference.

Various Commercial Advantages Provided by the Invention are as follows:

Immersing alloy articles or parts into aqueous acid, for example, HCl, solution before they are loaded into the gas furnace for infusion of interstitial solute will avoid the corrosive damage that is caused by the application of HCl gas in the conventional process.

Under the aspects of safety and environmental pollution and sustainability, usage of aqueous acid, such as HCl solution close to room temperature (18 to 50° C.), is much less problematic than using HCl gas at high temperature.

Surface activation by immersing in aqueous acid solution, for example HCl solution, can be performed within minutes, i.e. much faster than the 4 hours currently needed for activation by HCl gas (plus heating/cooling for an intermediate 2 h step for initial exposure to carburizing gas, see FIG. 1).

The above factors imply large reductions in production costs, improvements in safety, and environmental friendliness.

The processes of the present invention can be utilized with generally any article that comprises an iron-, nickel-, cobalt-, or titanium-base alloy containing alloying elements (e.g. chromium, manganese, titanium, aluminum) making the material capable of forming a hardened surface layer or "case" by diffusing high concentrations of carbon, nitrogen, or other interstitial solute atoms into the surface of the material without formation of precipitates. The invention is particularly applicable to case hardening of steels, especially steels containing from about 5 to about 50 weight percent nickel and about 10 to about 50 weight percent chromium. In one embodiment a metal alloy contains 10 to 40 weight percent nickel and 10 to 35 weight percent chromium. Also preferred are stainless steels, especially the AISI 300 series steels, superaustenitic stainless steels, precipitation hardened stainless steels, martensitic stainless steels, duplex stainless steels, and Ni-base and Co-base alloys. Of special interests are the AISI-316, 316L, 317, 317L and 304 stainless steels, alloy 600, alloy C-276 and alloy 20 Cb, to name a few non-limiting examples.

The present invention is also applicable to articles of any shape. Examples include pump components, gears, valves, spray nozzles, mixers, surgical instruments, medical implants, watch cases, bearings, connectors, fasteners, electronic filters, shafts for electronic equipment, splines, ferrules and the like.

Moreover, the present invention can be employed to case harden all the surfaces of the workpiece or only some (portion) of these surfaces, as desired.

Supporting Experimental Data

Results of Surface Analysis by XPS (X-Ray Photoelectron Spectrometry)

While the chromium atoms in an alloy, here AISI-316L, are in a neutral state of charge, the chromium atoms that participate in the surface oxide are positively charged ions. XPS is a technique that analyzes the topmost few atom layers of a specimen, and its energy resolution is sufficient to discriminate between photoelectrons emitted from chromium atoms in these different states. Therefore, XPS spectra can be analyzed to reveal what fraction of a surface is metallic, i.e. not (yet) covered by oxide. A suitable parameter for the metallic fraction of the surface is the ratio Rmet of integrated spectral intensity from chromium ions over the integrated spectral intensity from chromium in any charge state (ionized plus neutral). Such analysis was performed on as-received specimens (for reference) and specimens that were (i) etched in aqueous HCL solution for 0.6 ks (10 min), (ii) rinsed in either ethanol or water for 0.3 ks (5 min), and (iii) exposed to air for three different amounts of time. The resulting $R_{met}$ values, compiled in Table I, indicate that following surface activation with aqueous HCl solution by rinsing with ethanol—compared to rinsing in water—significantly retards oxidation.

| | Air | | |
|---|---|---|---|
| Rinse | 0.12 ks | 18 ks | 36 ks |
| Ethanol 0.3 ks | 70% | 17% | 17% |
| Water 0.3 ks | 17% | 8% | 12% |
| As-received | | 4% | |

In more than one decade of research in this field, we have established a variety of methods to verify successful CSS processing (carburization, nitridation, or a combination thereof—nitro-caburization).

Optical Metallography

Figure 2:
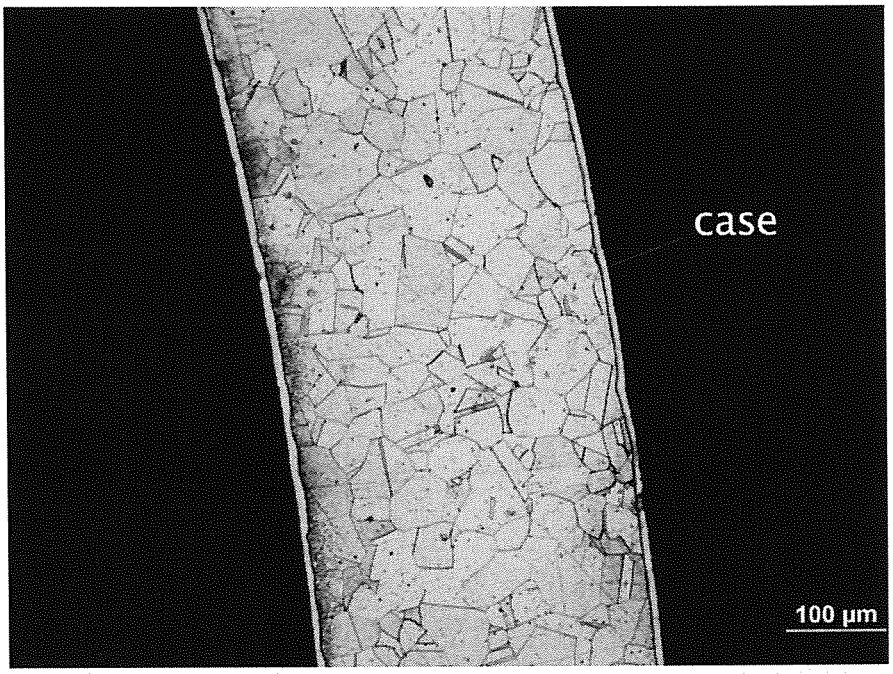
FIG. 2 is an image showing the wall of a nuclear-fuel cladding tube made from AISI-316L austenitic stainless steel. The "case" (hardened, corrosion-resistant carbon-rich layer at the alloy surface) is seen as featureless bright bands at the inner (left) and outer (right) side of the tube. This specimen was low-temperature-carburized without HCl gas. Instead, the surface was activated by immersing the tube in aqueous HCl solution.
Figure 3:
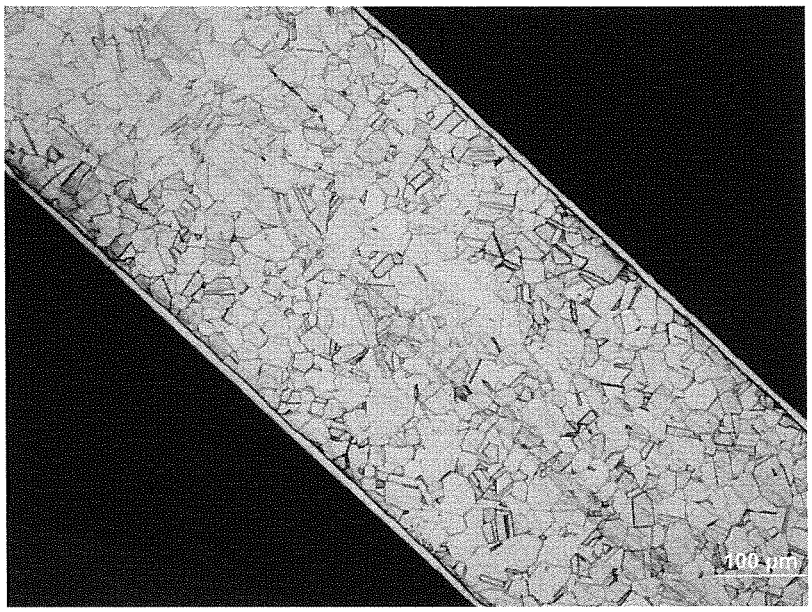
FIG. 3 is an image showing a polished and etched cross-section of an AISI-316L coupon (sheet-metal specimen), treated in the same way as the tube specimen.

After CSS processing, the "case" (hard shell) generated by the high concentration of interstitial atoms in solid solution can be observed by polishing a cross-section and exposing it to a chemical etchant that attacks the non-infused core of the alloy but not the (more corrosion resistant) interstitial-atom-rich layer near the surface. FIG. 2 shows an example of a low-temperature-carburized nuclear-fuel cladding tube of AISI-316L austenitic stainless steel. The "case" (hardened, corrosion-resistant carbon-rich layer at the alloy surface) is seen as featureless bright bands at the inner (left) and outer (right) surface of the tube. This specimen was low-temperature-carburized without HCl gas. Instead, the surface was activated by immersing the tube in aqueous HCl solution. This specimen was low-temperature-carburized for only 5 h. Nevertheless, the micrograph reveals a case thickness of about 10 μm. This result was reproduced with an AISI-316L "coupon" (sheet metal specimen), shown in FIG. 3.

One prior art process requires about 20 h and accomplishes a case depth of about 20 μm. Considering the known "square-root-of-time" law for the diffusion depth, which we have confirmed to apply in other studies, a fourfold increased processing time should double the case depth. This implies that with the new surface activation process we invented, we can accomplish the same case depth as the conventional process after a comparable CSS processing time (while significantly reducing the time needed for surface activation).

X-Ray Diffractometry

Large fractions of interstitial atoms dissolved in a metal matrix lead to a measurable expansion of the distances between the metal atoms. This expansion of interatomic spacings can be measured with the help of XRD (X-ray diffractometry). In X-ray diffractograms recorded in the Bragg-Brentano ("θ-2 θ") setting, the spacings of crystal lattice planes manifest themselves by reflections of the primary X-ray beam that are emitted from the specimen if the primary beam hits these planes under a characteristic angle, which fulfills the "Bragg" condition $$\lambda=2d\cdot\mathrm{Sin}\ [\theta],$$

where λ is the wavelength of the X-rays, d is the spacing of the lattice planes, and θ is the reflection angle. According to this equation, the expansion of a given plane spacings d will cause the corresponding reflection to occur at a smaller angle θ. This corresponds to a shift of the corresponding peak in the X-ray diffractogram towards smaller angles, i.e. to the left.

Figure 4:
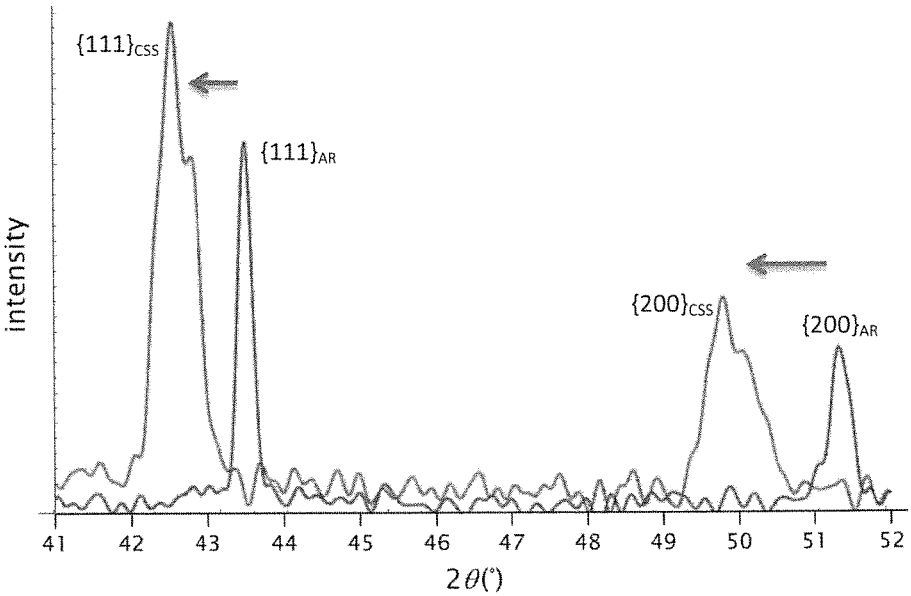
FIG. 4 illustrates X-ray diffractograms from AISI-316L specimens (noise-reduced by lowpass-filtering). Subscript CSS: Specimen surface-activated by immersion in liquid HCl solution (invention) and low-temperature-carburized for five hours. Subscript AR: As-received, non-carburized reference sample. The two peaks on the left represent the spacing of {111} lattice planes, whereas the two peaks on the right represent the spacings {200} lattice planes in the low-temperature-carburized ("CSS") and as-received reference ("AR") specimen, respectively. Compared to the corresponding "AR" peaks, the "CSS" peaks are shifted to lower diffraction angles. This indicates that the spacing of these lattice planes has increased after carburization. This, in turn, indicates a high concentration of dissolved carbon atoms, which expand the spacings between (and lattice plane spacings of) the ("substitutional") metal atoms because they reside in "interstitial" sites, i.e. between the metal atoms.

FIG. 4 illustrates X-ray diffractograms from AISI-316L specimens (noise-reduced by lowpass-filtering). Subscript CSS: Specimen surface-activated by immersion in liquid HCl solution (invention) and low-temperature-carburized for five hours. Subscript AR: As-received, non-carburized reference sample. The two peaks on the left represent the spacing of {111} lattice planes, whereas the two peaks on the right represent the spacings {200} lattice planes in the low-temperature-carburized ("CSS") and as-received reference ("AR") specimen, respectively. Compared to the corresponding "AR" peaks, the "CSS" peaks are shifted to lower diffraction angles. This indicates that the spacing of these lattice planes has increased after carburization. This, in turn, indicates a high concentration of dissolved carbon atoms, which expand the spacings between (and lattice plane spacings of) the ("substitutional") metal atoms because they reside in "interstitial" sites, i.e. between the metal atoms.

In earlier work we established a quantitative correlation between peak shift and carbon concentration. Evaluating the average of the peak shifts observed in FIG. 4 with the coefficient described in indicates a carbon concentration of about 8 at % at the alloy surface. Again, considering the processing time of only 5 h in this example, this result compares favorably with the prior art process, which accomplishes surface concentrations of 12 to 15 at % after processing for 20 h.

In accordance with the patent statutes, the best mode and preferred embodiment have been set forth; the scope of the invention is not limited thereto.

What is claimed is:

1. A process for preventing oxidation of a surface of an alloy article, comprising the steps of:

activating at least one surface portion of an alloy article with an aqueous acid solution having an acid pH range of from +4 to −1, wherein the acid of the acid solution is only one of hydrochloric acid, hydrofluoric acid, hydrobromic acid and sulfuric acid, wherein the alloy article comprises one or more of stainless steel, a nickel-base alloy, a cobalt-base alloy, and a titanium-base alloy; and immersing the at least one surface portion of the alloy article with a solution consisting essentially of an alcohol thereby coating the at least one surface portion of the activated alloy article with the solution consisting essentially of an alcohol after the activating step and prior to formation of a passivating layer on the at least one surface portion; and transferring the coated alloy article contacted with the solution consisting essentially of an alcohol to a furnace and evaporating the solution consisting essentially of the alcohol from the at least one surface portion of the alloy article by heating in one or more of a carburization and nitridation process on the alloy article in the furnace.

2. The process according to claim 1, wherein the activating step takes place outside of the furnace, which is capable of colossal supersaturation processing.

3. The process according to claim 1, wherein the alcohol comprises ethanol.

4. A process for activating a surface of an alloy article, comprising the steps of:

obtaining an article comprising an alloy that comprises one or more of a stainless steel, a nickel-base alloy, a cobalt-base alloy, and a titanium-base alloy;

activating at least one surface of the article with an aqueous acid solution, wherein the aqueous acid solution has an acid pH range from about +4 to about −1, wherein the acid of the acid solution is only one of hydrochloric acid, hydrofluoric acid, hydrobromic acid and sulfuric acid; and moving the article from the aqueous acid solution and placing the article in a second liquid solution comprising an alcohol, wherein the second liquid solution is a liquid having a boiling point that ranges from about 50 to about 500° C. that allows the second liquid solution to evaporate upon heating in one or more of a carburization and nitridation process; and transferring the article coated with the second liquid solution to a processing furnace and evaporating the second liquid solution from the at least one surface of the article by heating during the one or more of a carburization and nitridation process on the alloy article in the furnace.

5. The process according to claim 4, wherein the second liquid solution further comprises one or more of a fatty acid, an oil, and water.

6. The process according to claim 4, wherein the activating step takes place outside of the furnace.

7. The process according to claim 4, wherein the alcohol comprises ethanol.

* * * * *